US008377159B2

(12) United States Patent
Yoshida et al.

(10) Patent No.: US 8,377,159 B2
(45) Date of Patent: Feb. 19, 2013

(54) SYNTHETIC GRINDING STONE

(75) Inventors: Yuji Yoshida, Tokyo (JP); Hiroshi Eda, Kasama (JP); Libo Zhou, Hitachinaka (JP); Masaaki Kenmochi, Tokyo (JP); Yoshiaki Tashiro, Tokyo (JP); Sumio Kamiya, Toyota (JP); Hisao Iwase, Toyota (JP); Teruki Yamashita, Toyota (JP); Noboru Otake, Toyota (JP)

(73) Assignees: Tokyo Diamond Tools Mfg. Co., Ltd., Tokyo (JP); Toyota Motor Corporation, Toyota-shi, Aichi (JP)

( * ) Notice: Subject to any disclaimer, the term of this patent is extended or adjusted under 35 U.S.C. 154(b) by 666 days.

(21) Appl. No.: 12/450,366

(22) PCT Filed: Mar. 25, 2008

(86) PCT No.: PCT/JP2008/056279

§ 371 (c)(1),
(2), (4) Date: Sep. 22, 2009

(87) PCT Pub. No.: WO2008/117883

PCT Pub. Date: Oct. 2, 2008

(65) Prior Publication Data

US 2010/0037530 A1 Feb. 18, 2010

(30) Foreign Application Priority Data

Mar. 26, 2007 (JP) ..... 2007-079244

(51) Int. Cl.
*B24D 3/20* (2006.01)
*B24D 3/34* (2006.01)

(52) U.S. Cl. ..... 51/309; 51/298; 51/307

(58) Field of Classification Search ..... None
See application file for complete search history.

(56) References Cited

U.S. PATENT DOCUMENTS

| | | | |
|---|---|---|---|
| 2003/0104765 A1 | 6/2003 | Maeda et al. | |
| 2005/0086870 A1 * | 4/2005 | Kumasaka | 51/307 |

FOREIGN PATENT DOCUMENTS

| | | | |
|---|---|---|---|
| JP | 55-94981 | | 7/1980 |
| JP | 09085627 | A * | 3/1997 |
| JP | 2002-103238 | | 4/2002 |
| JP | 2002-355763 | | 12/2002 |
| JP | 2003-172839 | | 6/2003 |
| JP | 2004-261942 | | 9/2004 |
| JP | 2005136227 | A * | 5/2005 |
| JP | 2005-186246 | | 7/2005 |
| JP | 2005186246 | A * | 7/2005 |

OTHER PUBLICATIONS

Machine translation of JP 09-085627.*
Machine translation of JP 2005-136227.*
Machine translation of JP 2005-186246.*
International Search Report dated May 1, 2008 (2 pages).

* cited by examiner

*Primary Examiner* — Roy King
*Assistant Examiner* — Jared Wood
(74) *Attorney, Agent, or Firm* — Flynn, Thiel, Boutell & Tanis, P.C.

(57) ABSTRACT

A synthetic grinding stone used for the polishing of a silicon wafer is composed of a structure containing cerium oxide fine particles as abrasive grains, a resin as a binder, a salt as a filler and a nano diamond as an additive. This synthetic grinding stone is characterized in that the purity of the cerium oxide is not less than 60% by weight, the content of the salt as a filler is not less than 1% but not more than 20%, the volume content of the nano diamond as an additive is not less than 0.1% but less than 20% relative to the total volume of the structure, and the porosity as the volume fraction relative to the total volume of the structure is less than 30%.

7 Claims, 2 Drawing Sheets

SYNTHETIC GRINDING STONE

FIELD OF THE INVENTION

The present invention relates to a synthetic grinding stone that grinds the surface of a silicon wafer produced from a silicon single crystal, especially a bare silicon wafer or a device wafer by means of fixed abrasive grains in place of a series of polishing process using a conventional polishing pad. This synthetic grinding stone can be also applied to a grinding process of a back surface of a silicon wafer on the surface of which a single or multi layered integrated circuit is formed by device wiring.

DESCRIPTION OF THE PRIOR ART

Generally, a series of surface processing steps of a silicon wafer that is a substrate of semiconductor device, namely, a bare wafer including a device wafer, is performed as follows. That is, a bare wafer produced by slicing an ingot of a silicon single crystal is processed by several steps, e.g. a lapping process, an etching process, a pre-polishing process and a polishing process, so as to obtain a mirror-finished surface. During the lapping process, the dimensional accuracy of a wafer, such as parallelism or flatness, and form accuracy of a wafer are obtained, and in a etching process, a work damaged layer caused by the lapping process is removed, further, in a pre-polishing process and a polishing process, a mirror-finished surface is formed, maintaining good form accuracy. In general, said pre-polishing and polishing process are performed using a polishing pad with a liquid of a polishing compound containing a slurry of abrasive grains. This polishing compound contains an acid component or basic component, and the processes are advanced by the chemical action of the acid or base (corrosive action to silicon wafer) and mechanical action by fine particles of abrasive grains contained in the polishing compound.

The above-mentioned method is generally performed by performing a pre-polishing process using, for example, a sheet of rigid polyurethane foam, then by a polishing process using, for example, a polishing pad composed of a suede-type synthetic leather. A workpiece such as a silicon wafer is pressed against a platen, to which the above-mentioned sheet or pad are adhered, and both the platen and workpiece are rotated with the constant supply of the liquid of the polishing compound containing the slurry of fine particles of abrasive grains, and chemical mechanical polishing is performed. The machining mechanism of these pre-polishing and polishing processes are different from that of a lapping process, which is a previous process to these polishing processes and uses hard and loose abrasive grains such as fine particles of alumina. For example, the chemical action of an acidic component or a basic component, which are components contained in a solution of a polishing compound, specifically corrosive (erosive) action of said components on a workpiece such as a silicon wafer is used. That is, by the corrosive action of an acid or alkali, a thin and soft eroded layer is formed on the surface of a workpiece such as a silicon wafer. Said chemically weakened thin layer is removed by the mechanical•chemical action of fine particles of abrasive grains, thus, the machining of a workpiece proceeds. In an ordinary grinding process, it is essential to use harder abrasive grains than a workpiece, however, in a case of chemical mechanical polishing, it is not necessary to use harder abrasive grains than a workpiece. Therefore, this polishing method can be used for a machining process whose load to a workpiece is very low.

In general, a liquid of a polishing compound containing colloidal silica as a main abrasive component and further containing an acid or base (for example, patent document 1) can be used, further, a liquid of a polishing compound that uses other abrasive grains such as cerium oxide together with colloidal silica (for example, patent document 2) can be also used. In these methods, polishing is performed by pressing a workpiece to a flexible sheet or a polishing pad by a high pressure and rotating them in wet condition so as to rub the surface of a workpiece. Accordingly, these methods have problems in dimensional accuracy, form accuracy, continuation of effect and stability, which are caused by the use of a flexible sheet or polishing pad, and problems of roll off phenomenon at outermost periphery parts of the workpiece after a polishing process can not be avoided.

Further, these methods also have the following problem, that is, along with the change of surface condition of a polishing pad caused by loading or damage, the machining rate changes by time lapse, therefore, the technical difficulty for performing quantitative machining by routine work is high. Furthermore, specific problems caused by use of a slurry, that is, the contamination of a workpiece after being polished, contamination of a polishing machine and environmental pollution by wasted liquid cannot be avoided. Accordingly, establishment of a washing process, shortening of a maintenance cycle of polishing machine and enlargement of loads to a waste liquid treatment facility are pointed out as problems.

To avoid these problems, and from a view point that a conventional method that uses a polishing pad, which has a problem in dimensional stability, cannot meet requirements to obtain a more precise surface roughness, form accuracy and dimensional accuracy at the nano meter level, a method of using a synthetic grinding stone as a machining means is proposed in Patent Document 3. Generally, the term "synthetic grinding stone" indicates an article prepared by bonding fine particles of abrasive grains by a bonding material and particles of abrasive grains are fixed in a structure of grinding stone. As abrasive grains, any kind of abrasive grains used ordinarily can be used and, as bonding materials, any kind of compound that has the ability to fix abrasive grains can be used, however, in general, metal, rubber, ceramics or resins are preferably used.

In the above-mentioned Patent Document, a grinding stone prepared by fixing abrasive grains having a strong grinding ability, such as diamond abrasive grains, by metal bonding or hard resin bonding is used, and mirror-finishing is tried using an infeed type precision grinding machine having a high transcribe ability. Since this type of grinding machine does not use a polishing pad, which has problems in dimensional stability and form stability, it is possible to suppress factors causing problems of form accuracy, such as roll-off, at the outermost peripheral part of the work. Further, since abrasives act in a condition that the abrasive grains are fixed in the structure of a grinding stone, namely, act as fixed abrasive grains, this method is closer to theoretical accuracy, and has advantages that the aimed surface roughness can be more easily performed than the method that uses loose abrasive grains.

Further, said method is not only effective in solving problems regarding surface roughness and dimensional or form stability, such as roll-off, but is also effective in shortening the number of processes, including previous processes, to the polishing process, and has the possibility of performing a through process of silicon wafer machining. However, this method has a problem in that geometrical scratches specified to fixed abrasive grains caused by the use of fixed abrasives are drawn on surface of a workpiece and the scratches become latent defects and, further has a problem of fine chipping.

Therefore, this method cannot be said to be a perfect method. Especially, when diamond abrasive grains, which have an excellent grinding force, is used, the above-mentioned tendency becomes remarkable. Furthermore, when a change of form or dimension of the grinding stone itself by alteration of factors of the environment such as temperature, humidity or pressure is remarkable, it is unavoidable that the problems of surface roughness, dimensional or form stability are remaining.

Still further, in Patent Document 4, a specific synthetic grinding stone (CM grinding stone) for chemical mechanical grinding is proposed. That is, said grinding stone is characterized in containing a component, which indicates an acidity or alkaline feature when dissolved in water, in the grinding stone as a rigid component previously and to form a specific pH environment during actual use in a wet condition. In said Patent Document, it is indicated that the use of abrasive grains whose hardness is lower than that of diamond abrasive grains is effective, in particular, it is disclosed that the use of cerium oxide as abrasive grains gives good results. Although this grinding stone provides good grinding effects, it has problems in the consistency and static and dynamic stability of the grinding stone structure itself, and is required to improve the characteristics of the grinding stone, because the deformation and wear of the grinding stone actually is large and the setting up of the grinding condition is slightly difficult. In actual use, the grinding stone is not sufficient to perform mirror finishing on large diameter silicon wafer of 300 mm ϕ. A synthetic grinding stone using a highly purified cerium oxide as abrasive grains is proposed in Patent Document 5 or Patent Document 6. However, in a case of Patent Document 5, an object to be polished is restricted to amorphous glass. Further, since the wear of the synthetic grinding stone is high and the grinding ratio of the grinding stone is very low, the grinding stone is not suited for the grinding of a silicon wafer composed of silicon single crystal. Further, in a case of Patent Document 6, an object to be polished is restricted to a thin film of silicon oxide (SiO2) formed on a silicon wafer, and since the purpose of the synthetic grinding stone is to obtain a uniform surface by a very small removal volume, the grinding stone cannot be applied for the polishing of a large removal volume, such as the surface polishing of a bare silicon wafer or back surface grinding of a device wafer.

Furthermore, in Patent Document 7, the surface machining of a workpiece using cerium oxide grinding stone is disclosed. This document relates to a grinding method by the use of a grinding stone containing cerium oxide as abrasive grains, however, the components and structures of the grinding stone and grinding function of the grinding stone are not disclosed clearly, further, the purity of the cerium oxide and effect of it are not disclosed clearly. The kinds of fillers or additives and effects of them are not specifically recited.

Further, a technique to use cluster diamond, whose surface is graphitizated, as a component of abrasive grains is disclosed (for example, Patent Document 8), and in Patent Document 9, a metal bond grinding stone that uses graphite as a solid lubricant is mentioned. These are prior art that apply the lubricity of graphite, which graphite originally has, to a grinding action and aim for an improvement of the smoothness of the grinding action.

As a grinding machine that loads these grinding stones and performs surface machining by infeed motion or by pressure control motion, a machine disclosed in Patent Document 10 can be mentioned.

Patent Document 1: U.S. Pat. No. 3,328,141
Patent Document 2: U.S. Pat. No. 5,264,010
Patent Document 3: JP 2001-328065 publication
Patent Document 4: JP 2002-355763 publication
Patent Document 5: JP 2000-317842 publication
Patent Document 6: JP 2001-205565 publication
Patent Document 7: JP 2005-136227 publication
Patent Document 8: JP 2005-186246 publication
Patent Document 9: JP 2002-066928 publication
Patent Document 10: JP 2006-281412 publication

DISCLOSURE OF THE INVENTION

The inventors of the present invention earnestly investigated the above-mentioned prior art and accomplished the present invention. The object of the present invention is to provide a grinding stone that can perform surface polishing and planarization of a silicon wafer, a semiconductor element manufactured from silicon wafer, especially, a bare wafer effectively in the condition of no strain (no work damaged layer, no residual stress) and no silicon atom defects.

That is, the inventors of the present invention have found that a grinding stone characterized in that its change in ability and function are small and having an excellent grinding effect can be obtained by use of fine particles of highly purified cerium oxide ($CeO_2$) as an abrasive, a resin as a bonding material, salts as a filler and nano-diamond (ultra fine diamond of nano meter size) as an additive, as main components of the synthetic grinding stone. By performing machining on a silicon wafer using the synthetic grinding stone of the above-mentioned construction, the potential of the Si atom bond existing in the machining range can be weakened in a moment of the machining and at the moment —O—Si—O— can be swept away selectively by a lower pressure. Thereby, the inventors of the present invention have found that a grinding stone which is excellent in homogeneity, form stability against heat or pressure, heat resistance, pressure resistance, conductivity and transmitting ability of grinding temperature, further, deformation of the grinding stone, friction and wear at actual use are even and relatively small, furthermore, characterized in that change of ability and function is small and is excellent in grinding effect, can be obtained by use of nano diamond as an additive. In particular, the inventors have found that the purity of the cerium oxide contributes to an improvement in the grinding force of a synthetic grinding stone and prevents the cause of defects such as scratches. Further, the inventors have found that the selection of the kinds and amount of nano-diamond, which is an additive, contributes to an improvement in the dimensional and form stability of the synthetic grinding stone against heat or pressure, improvement in vibration absorbing ability by dynamic vibration of abrasive (m), damping (c) and spring (k) and improvement in grinding force by the reduction of the numbers of grinding factors.

Salts added as a filler weaken the potential of the Si atom bond in a moment; ps (pico second order), and obtain an effect of removing its function by scratching action. Nano-diamond to be added as an additive has an effect of removing —O—Si—O— selectively by lower pressure by lubrication and radiation of heat. In the present invention, the term nano-diamond indicates a cluster diamond, a perfectly graphitized product of a cluster diamond and a cluster diamond whose surface part is partially graphitized (graphite cluster diamond: GCD).

Recently, the purity of the cerium oxide of a product that is dealt with as a cerium oxide compound is indicated by weight % of rare earth oxide (TRO) to whole part and by weight % of cerium oxide contained in the rare earth oxide ($CeO_2$/TRO), and these two values are often mentioned together. In the present invention, when these two values are mentioned together, the purity of the cerium oxide is indicated by the product of these two values. For example, when the weight % of TRO is 90% and the weight % of $CeO_2$/TRO is 50%, the purity of cerium oxide is (90×50)/100=45 weight %.

The above-mentioned object of the present invention can be accomplished by a synthetic grinding stone comprising fine particles of cerium oxide as an abrasive, a resin as a bonding materials, salts as a filler and fine particles of graphite cluster diamond as an additive, and these components are the main components of the synthetic grinding stone, wherein, the purity of the cerium oxide is 60 weight % or more, the content of the salts contained as a filler is in the range from 1% or more to less than 20% by volume % to the whole structure and the content of the fine particles of graphite cluster diamond as an additive is in range from 0.1% or more to less than 20% by volume % to the whole structure.

PREFERRED EMBODIMENT OF THE INVENTION

Figure 1:
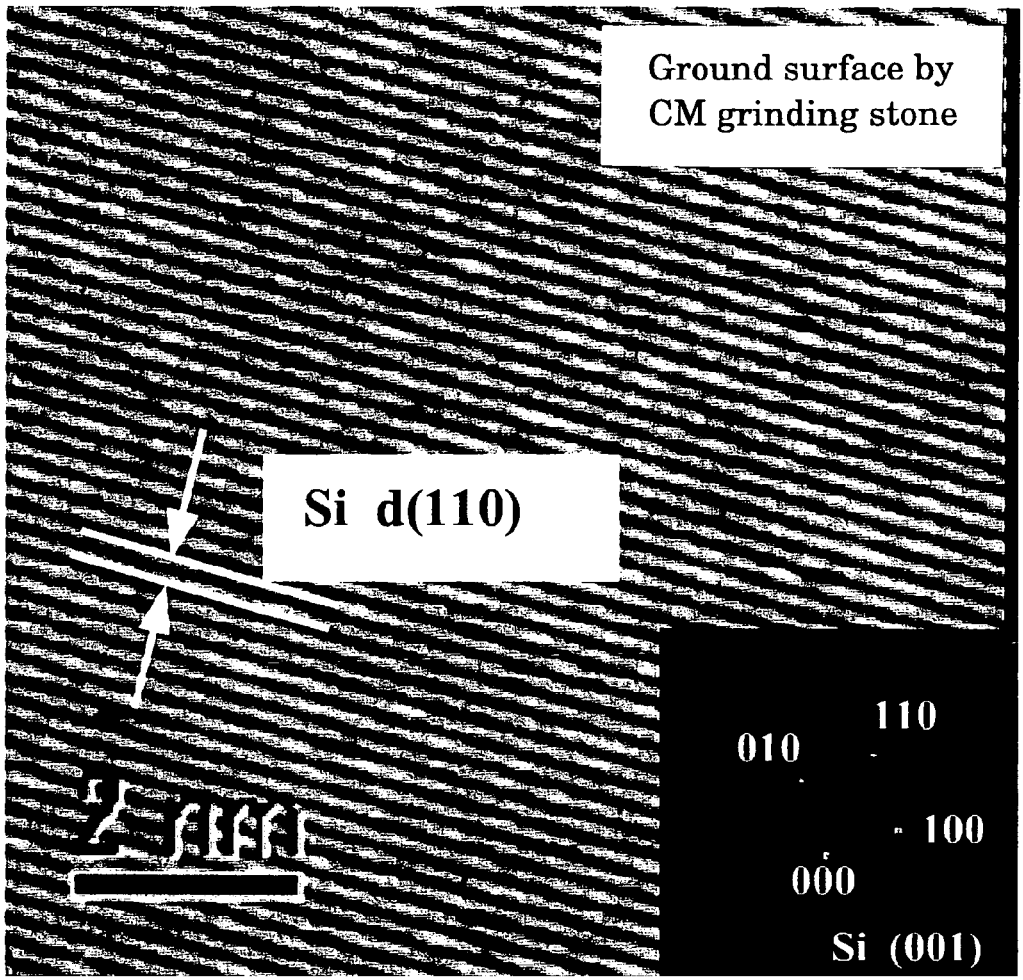
FIG. 1 is a TEM observation picture of the surface of a silicon wafer ground by the grinding stone of Example 3 and the electron beam diffraction of it (right lower part).

The first important point of the present invention is to use cerium oxide of a high-purity grade with the cerium oxide content being 60 weight % or more as abrasive grains. Generally, cerium oxide mined as bastnaesite ore contains large amounts of impurities, such as other rare earth elements or hafnium, and removal of these impurities is difficult. Therefore, cerium oxide of 40 to 60 weight % purity is used as the cerium oxide abrasive grains. The inventors of the present invention earnestly investigated the grade of the cerium oxide abrasive grains to be used in the synthetic grinding stone of the present invention and found that defects such as scratches on the surface of a workpiece when ordinary low purity cerium oxide, which is used for polishing of glass, is used as an abrasive grains, can be prevented by the use of high purity grade cerium oxide as an abrasive grains. Further, the time for processing is the same or shorter than that for the ordinary chemical mechanical polishing of a bare wafer. That is, when the purity of the fine particles of cerium oxide used as abrasive grains becomes higher than 60 weight %, a vivid chemical reaction environment is formed between a $SiO_2$ molecule, Si atom and $CeO_2$ and, in Si—$O_2$ and Ce—$O_2$, the $Ce^{3+}$ ion reacts with Si—$O_2$ and forms Si—$CeO_2$ in a moment. For example, when GCD of 50-300 Å is added by 0.1-20% to the synthetic grinding stone, the physical, chemical features of $CeO_2$—$Na_2CO_3$—GCD-$CaCO_3$-bonding material such as heat conductivity, affinity and vibration damping are improved and stabilized. Consequently, thermal stoppage near abrasive grains is protected, and the weakening of the bonding potential of abrasive $CeO_2$—$SiO_2$ causes grinding temperatures of 150-250° C. under a lower pressure machining environment in a moment of 0.5 ps-1 ps. Said radical weakening phenomenon of $CeO_2$—$SiO_2$ can be explained as follows. That is, under a dry condition at 150-250° C., the bonding potential $\phi(r)$ (r: interatomic distance) of $S_{SiO2}$-$O_{SiO2}$ closes to zero, and abrasive grains scratch the surface. This change takes place in a moment in the case of $CeO_2$ while, in the case of $SiO_2$, the change takes place very slowly and continuously. Consequently, Si is formed on the surface. In the machining process using the synthetic grinding stone of the present invention, when a chemically active machining environment is formed without using a grinding fluid, a perfect surface characterized in that there is no natural oxidized film ($SiO_2$), no strain in the Si atom lattice, further, no residual stress can be obtained.

The effect becomes more remarkable by the use of cerium oxide whose purity is 60 weight % or more, and by the use of cerium oxide whose purity is 90 weight % or more, with a very remarkable effect being obtained. That is, the lattices are lined up at a constant distance and this phenomenon can be observed by electron beam diffraction. The synthetic grinding stone of the present invention can be accomplished by the use of fine particles of a high purity cerium oxide whose content of cerium oxide is 60 weight % or more. A more desirable purity of cerium oxide is 95 weight % or more, and the use of cerium oxide whose cerium oxide purity is 99 weight % or more has no problem in efficiency, however, it has a problem in economical competitiveness.

A desirable content of cerium oxide in the present invention is from 15 to 70% by volume to the whole structure of the grinding stone. When the content is smaller than 15%, its effect as abrasive grains is not sufficient and when in excess of 70%, excess cutting edges of abrasive grains participation and re-regulation of thermal gripping forth of bonding material+filler+additive and abrasive grains by optimum chemical reaction take place and re-set up of optimum machining condition is caused. Further, the grinding stone becomes structurally brittle and is not desirable from a view point of fracture toughness.

The reason why a very high machining accuracy can be obtained by the use of fine particles of a high purity cerium oxide is illustrated as follows. That is, a high purity cerium oxide abrasive of less than approximately 3 μm is an aggregate of ultra fine particles of less than approximately 5 nanometers. While, the silicon wafer is a single crystal of silicon, and the silicon atoms are regularly arranged in a tetrahedral structure of a diamond structure. In the machining process, when the radical degree of machining point is raised and the vibration of crystal lattice atoms is enhanced, the silicon is thermally stimulated and the amplitude becomes larger by the addition of thermal lattice vibration, then the potential $\phi(r)$ between atoms drops. When said condition is formed, an atoms layer of silica is removed by the machining force of ultra fine particles of cerium oxide, which is brought by the effect of an increase in space density from $Ce^{3+}$ to $Ce^{4+}$ ion and thermal activity of $SiO_2$ molecule formed by the mutual reaction of Si—$CeO_2$. That is, since the lattice sliding takes place in the (111) direction and layers are peeled off gradually, very precise machining accuracy can be obtained. This effect can be obtained by setting a machining point to a specific machining condition, specifically, to an activated thermal machining condition of from 80° C. to 300° C., desirably from 150° C. to 250° C.

Further, the second important point of the present invention is to use a resin, desirably a thermosetting resin, as a bonding material that grips and bonds fine particles of cerium oxide abrasive in the structure of the grinding stone stably. A cured product of the thermosetting resin is prepared by heat setting the resin and cured irreversibly by heat. The cured resin is characterized by not dimensionally changing against thermal changes, environmental changes in use (physical feature changes or dimensional changes by humidity or temperature), solvents (dissolving, swelling, shrinking, plasticizing, softening) or time lapse. Therefore, when the resin is used as a bonding material of a grinding stone, the resin contributes to the form stability and dimensional stability of the grinding stone. The above-mentioned functions, that is, thermal stability, weather resistance or solvent resistance are indispensable functions and are important points for a synthetic grinding stone that needs precise form accuracy and dimensional accuracy on the nanometer level. For stabilizing these functions, it is necessary to complete the curing reaction of a thermosetting resin to be used perfectly. Namely, a synthetic grinding stone whose curing reaction is still progressing during actual use as a grinding stone must be avoided. The curing reaction of a thermosetting resin to be used progresses by the thermosetting reaction of a precursor or pre-polymer of the thermosetting resin and, for the purpose of completing the curing reaction during the manufacturing process of the grinding stone, it is necessary to perform a heat treatment at the curing temperature of the thermosetting resin or a slightly higher temperature than the curing temperature for sufficient heat treatment time, and use of a curing (crosslinking) catalyst is also effective.

In the present invention, as a thermosetting resin to be used as a bonding material, at least one thermosetting resin selected from the group consisting of phenol resins, epoxy resins, melamine resins, rigid urethane resins, urea resins, unsaturated polyester resins, alkyd resins, polyimide resins, polyvinylacetal resins are desirably used. However, from the view point of thermal stability or toughness (fracture toughness $K_I$, $K_{II}$, $K_{III}$) the most desirable thermosetting resin among the above-mentioned thermosetting resins is a phenol resin (bakelite resin). These resins can be an uncured precursor of a pre-polymer in the manufacturing process of a grinding stone. However, after the manufacturing process, curing by heat must be completed in the obtained product. That is, after the synthetic grinding stone is manufactured, physical features such as hardness or form must not be changed by heat or other conditions. In the present invention, use of a curing (crosslinking) catalyst for the above-mentioned thermosetting resin is effective for the improvement of form stability.

In the present invention, the term resin volume percentage indicates the content of the resin and is indicated by volume content to whole structure.

The third important point of the present invention is to add salts, especially metal salts, as a filler.

The machining efficiency of a synthetic grinding stone of the present invention depends on the machining pressure at the grinding process. By elevating the machining pressure, the problems of burn marks at the machining surface or scratches often take place. These problems can be remarkably solved by adding a metal salt as a filler. As a metal salt, an inorganic salt consisting of an inorganic acid and inorganic base is desirably used. Asa desirable example, sodium carbonate ($Na_2CO_3$), potassium carbonate ($K_2CO_3$), calcium carbonate ($CaCO_3$), water glass (sodium silicate: $Na_2SiO_3$) or sodium sulfate ($Na_2SO_4$) can be mentioned. However, the invention is not limited to these salts. By forming said composition, a synthetic grinding stone that can endure to high machining pressure can be obtained. That is, in a case of a synthetic grinding stone that uses a thermosetting resin alone as a bonding material, the upper limit of machining pressure to be loaded to the grinding stone is approximately 0.05 MPa and, when exceeding this upper limit, burn marks takes place and it becomes difficult to continue the machining process. By using a metal salt as a filler, the upper limit can be improved to approximately 0.12 MPa. When the grinding process is made by 0.05 MPa machining pressure, a synthetic grinding stone containing metal salt as a filler gives a better machining efficiency than that of a synthetic grinding stone not containing a metal salt.

It is necessary that the amount of metal salt to be added is within the range of from 1% or more to less than 20% by volume % to the whole structure. When smaller than 1%, the effect of the metal salt is not sufficient and, when it exceeds 20%, the adding amount is excessive and not only gives a bad effect to the physical properties of the grinding stone, such as intensity or hardness, but also obstructs the function of the bonding materials for the grinding stone or effect of GCD. Especially, it is desirable that the amount of metal salt to be added is within the range from 5% or more to less than 18% by volume to the whole structure.

The fourth important point of the present invention is to use nano diamonds as an additive. The contents of nano diamond is in the range of from 0.1% or more to less than 20% by volume % to the whole structure. In the synthetic grinding stone of the present invention, as a nano diamond to be added as an additive, graphite cluster diamond (GCD) is desirably used. In a process of producing cluster diamond by explosion reaction, diamond fine particles having a graphite layer on the surface on it can be obtained as an intermediate. That is, diamond fine particles whose surface is graphitized and core part is diamond. In other words, diamond fine particles whose surface is coated with graphite can be obtained and this intermediate product is called as GCD. Especially, particles of 50 Å (5 nm) to 300 Å (30 nm) particle size gives a desirable result. By adding the prescribed amount of nano diamond, the effect of scraping off —O—Si—O— by a low grinding pressure can be obtained. Further, by adding GCD to a grinding stone, the grinding efficiency does not change, and effective and uniform grinding can be continued continuously. By adding GCD to a grinding stone, the following effects can be obtained, that is, the gripping strength for the abrasives are homogenized and become isotropic, the isotropic conductivity of the grinding heat and heat conductivity are improved, the friction and wear are decreased, the self dressing ability of the abrasive grains is maintained stably, and the abrasive vibration damping is improved (approximately 10 times).

The synthetic grinding stone of the present invention is a structural body and can possess pores in the structure. The pores exist in the structural body as independent pores or continuous pores, and the shape and size are relatively homogeneous. By the presence of the pores, grinding chips formed during the grinding process are caught in the pores and prevent the accumulation of grinding chips on the surface and further can prevent the stoppage and storing up of grinding heat. As a method of forming pores, a method of lending an adequate pore-forming agent in the production process of grinding stone, or a method of adjusting the pressing condition in the blending process of the starting materials and baking process and to form pores can be mentioned. In the present invention, a desirable porosity is in the range from 1% or more to less than 30% by volume % to the whole structure.

Arranging these static•dynamic main factors of the grinding stone, the Si perfect crystal ground surface is characterized in that the strain of the Si atom lattice is closer to zero and there is no structural change, such as formation of a natural oxide film $SiO_2$ obtained, by performing an adequate grinding condition with a synthetic grinding stone and chemically constructing an active field of grinding heat of $CeO_2$-bonding material-pore and silicon wafer. More in detail, the machining action as two bodies contact slidingly can improve the presence of the removing ability according to the following numerical formula.

Intrusion depth of abrasive grain $d=\frac{3}{4}\phi(P/2CE)^{2/3}$ In a case of a CM (chemical mechanical) grinding stone, when the pressure P (in this condition, 5 kpa-5 Mpa), particle size of the abrasive grains$\phi$ (2.3 μm), concentration of the abrasive grains C (70%), Young's modulus of Si E (170 GPa) are inserted into the numerical formula, the mechanical intrusion depth of the abrasive grains is approximately 0.01-1 nm. In this condition, machining is proceeded by a ductile mode. Since the covalent bond force of Si is weakened, $SiO_2$ is removed as being dredged up. This phenomenon can be explained as follows, that is, the thermal stoppage of the $CeO_2$ abrasive grains in a synthetic grinding stone is protected, stabilizes a weakened radical of the bond population (Si—$O_2$ bond potential $\phi$ in molecular dynamics) to $SiO_2$ at grinding temperature of 150-250° C., and a continuation effect can be performed. The effect can also be based by simulation of the grinding heat of molecular dynamics. From the results, it is confirmed that the removal of Si from several nm to several 100 nm by every minute (calculated from change of wafer thickness) is performed not-withstanding the intrusion depth of the abrasive grains of the CM grinding stone d=0.01-1 nm. As mentioned above, it is obvious that a chemical reaction takes part in the dry grinding mechanism. For example, $SiO_2$ formed on silicon wafer surface forms a silicate by a solid-phase reaction with $CeO_2$ abrasive grains as indicated by the following chemical reaction formula.

$$2CeO_2+2Si—O—Si \longleftrightarrow 2Si—O=Ce—O—Si+O_2$$

This silicate becomes very soft and is considered to weaken the energy of the atomic layer potential $\phi(r)$ at the machining surface. Therefore, the silicate can be removed easily by the abrasive grains, which is an oxide, even if under a dry condition. If thermal stoppage takes place at the interface of the $CeO_2$ abrasive grains—bonding material (including fillers), an excess $SiO_2$ film is firmly formed and a machining layer is formed. However, in the case of the synthetic grinding stone of the present invention, a machining layer consisting of a $SiO_2$ film is not formed. The important point in above mentioned chemical reaction formula is that high temperature of 200° C. or more is necessary to progress the chemical equilibrium to the right direction.

To the synthetic grinding stone of the present invention, additives that are added to a conventional grinding stone can be added. Specifically, a filler, a coupling agent, an antioxidant, a coloring agent or a slipping agent can be added if necessary.

In the present invention, a type of grinding machine to which a grinding stone is set and put in a practice grinding process is not particularly restricted. A conventional polishing machine on a platen of which a grinding stone is set instead of a polishing pad can be used. Grinding is performed by pressing a workpiece (object to be ground) to the grinding stone by a certain pressure and by rotating both workpiece and platen. Further, an ultra-precision grinding machine of a so-called constant cutting depth processing method can be used. This ultra-precision grinding machine is characterized in that a grinding stone and a workpiece are arranged on the same axis so as to face each other, and both the grinding stone and the workpiece are rotated at a high speed, and at least one of the grinding stone or the workpiece are moved by a very small distance according to a previously prescribed cutting depth. An ultra-precision grinding machine of a constant-pressure processing method that performs grinding of a workpiece can be also used.

Especially, for the purpose of approaching the aforementioned activated thermal machining condition of from 80° C. to 300° C., desirably from 150° C. to 250° C., it is desirable to use a so-called ultra-precision grinding machine of constant-pressure processing or constant cutting depth processing, for example, a machine characterized in that a grinding stone and a workpiece are arranged on the same axis so as to face each other and both the grinding stone and the workpiece are rotated at a high speed, and at least one of the grinding stone or the workpiece are moved a very small distance according to a previously prescribed cutting depth, and is desirable to set up the rotating speed and other conditions of the machine to a specific condition. For example, the use of an ultra-precision grinding machine disclosed in Patent Document 10 is desirable. These ultra-precision grinding machines can control the grinding temperature by adjusting the grinding pressure or relative motion of a grinding stone. In this case, the preferable shape of a grinding stone is cup-shaped or disk-shaped and both grinding stone and workpiece are rotated at a high rotating speed. If these ultra-precision grinding machines are used for machining of a bare wafer, there is an advantage that not only a polishing process but also forming processes to the polishing process such as lapping, etching or pre-polishing processes can be performed by the same machine as a through process.

A method for manufacture of the grinding stone is not specifically restricted and the stone can be manufactured according to a method of an ordinary resin bond grinding stone. For example, in a case of using a phenolic thermosetting resin as a bonding material, a grinding stone can be manufactured by the following method. That is, a prescribed amount of fine particles of cerium oxide, a powder of a precursor or pre-polymer of a thermosetting phenol resin, filler and additives, which are starting materials, are blended homogeneously and contained in a prescribed mold and molded by pressing, then, heat-treated at a temperature higher than the curing temperature of the thermosetting phenol resin. The precursor or pre-polymer of a thermosetting phenol resin can be in a liquid state or a solution dissolved in a solvent. In this case, it is desirable to make the mixture of starting materials a paste. If necessary, a curing catalyst, a foaming agent or other additives can be added.

For the purpose of processing a silicon substrate (single crystal) having a $SiO_2$ film on the surface skin of a silicon semi-conductor to a silicon wafer characterized in not having a residual stress, structural change and work damaged layer, the combination use of a grinding stone of the present invention with the above-mentioned ultra-precision grinding machine of a horizontal type or vertical type and operated by practical conditions is desirable. For example, when $CeO_2$ is held by a Si—Si bond and GCD, the interatomic potential $\phi(r)$ can be shown by following equation, $$\phi(r)=D(\exp\{-2\alpha(r-r_0)\}-2\exp\{-d(r-r_0)\})$$

wherein, r is interatomic distance ($r_0$ is initial position), D is Interatomic potential of the material and $\alpha$ is the material constant ($A^{-1}$)

In a case of $\phi(r)=0$ ev, the interatomic distance of the Si—Si atom r≈2.2 Å, interatomic distance of Si—C (GCD) atom r≈1.8 Å, and interatomic force F(r)=0 means that by addition of GCD, the Si atom layer is scraped off layer by layer orderly without a cutting function because the Si—Si atom r≒2.2 Å and Si—C atom r≒2.0 Å. This simulation result can be verified by manifestation 〔Si(001)〕 of the lattice spacing of 3.94 Å (theoretical value is 3.84 Å).

The synthetic grinding stone of the present invention constructs the combination of grinding stone+$SiO_2$—Si in optimum containing % of $CeO_2$-GCD-bonding material-filler-additive-pores.

When the grinding is performed by a machining condition (machining pressure is 1 MPa and relative speed is 15 m/s), reaction of $(CeO_2)^-$ and $(SiO_2)^{2+}$ generates a grinding temperature of 150-250° C. Then a thermochemical reaction of $$Si+O_2 \rightarrow (SiO_2)^{2+}+2e^- \rightarrow SiO_2$$

takes place between the abrasive grains, $SiO_2$ and Si at the interface. A reduction of the numbers of Si bond electrons before and after the reaction indicates a weakening of Si covalent bonding strength. Therefore, in this reaction, oxygen is consumed and $e^-$ is released. Accordingly, the chemical reaction of $$2(CeO_2)+2e^- \longleftrightarrow 2(CeO_2)^- \longleftrightarrow CeO_3+\tfrac{1}{2}O^-$$

progresses toward the right. Further, the intermediate products $(CeO_2)^-$ and $(SiO_2)^{2+}$ in the above-mentioned two formulae react and form a composite product (Ce—O—Si).

$$(SiO_2)^{2+}+2(CeO_2)^- \longleftrightarrow Ce_2O_3.SiO_2$$

This composite product is an amorphous product whose bonding strength is very weak. The micro strength of Si(100) single crystal is 11-13 GPa, while the hardness of $CeO_2$ is about half (5-7 GPa). Therefore, it is difficult to remove Si by $CeO_2$. Accordingly, in CM grinding stone machining, since the cutting function does not work, a work-damaged layer is not formed. That is, this condition possesses the [Xe] $4f^1 5d^1 6s^2$ atomic sequence of Ce. Consequently, the grinding condition of a rigid grinding stone in which two kinds of oxides of $CeO_2$ and $Ce_2O_3$ exist, depending on whether the ionic valency is Ce(III)/$Ce^{3+}$ or Ce(IV)/$Ce^{4+}$ and combining condition of starting materials of CM grinding stone, perform machining of a 300 mm ϕ diameter silicon wafer and don't have a work-damaged layer by provision of optimum machining atmosphere (grinding temperature 150-250° C.).

The present invention will be illustrated more in detail according to the Examples and Comparative Examples, however, it is not intended to limit the scope of claims of the present invention to the Examples.

EXAMPLES AND COMPARATIVE EXAMPLES

Synthesis of Grinding Stones

As an abrasive grain, fine particles of cerium oxide whose average particle size is 1-3 μm is used. As a bonding material, thermosetting phenol resin powder, as a filler, sodium carbonate, as an additive, graphite cluster diamond whose particle size is approximately 100 Å are used. These four components are mixed together homogeneously and poured into a prescribed mold and heated and pressed. Grinding stones of Examples 1-4 and Comparative Examples 1-4 of 5.2×10×40 mm size are obtained. The baking conditions at the grinding stone molding are mentioned below.

Temperature-programmed, room temperature→80° C.: 10 minutes

Maintained at 80° C.: 5 minutes

Pressed and temperature-programmed 80° C.→100° C.: 10 minutes

Temperature-programmed 100° C.→190° C.: 15 minutes

Maintained at 190° C.: 18 hours

Cooled down to room temperature: 30 minutes

The $CeO_2$ purity of the fine particles of cerium oxide used as abrasive grains in Examples 1-3, 5 and in Comparative Example 1-3 and 5 is 96.5 weight %, the $CeO_2$ purity of the fine particles of cerium oxide used as an abrasive grains in Example 4 is 65.8 weight % and the $CeO_2$ purity of the fine particles of cerium oxide used as abrasive grains in Comparative Example 4 is 42.5 weight %. Abrasive grains volume percentage, resin volume percentage, filler volume percentage, additives volume percentage and porosity of the grinding stones of Examples 1-5 and Comparative Examples 1-5 are shown in Table 1.

TABLE 1

| | abrasive volume percentage vol % | resin volume percentage vol % | filler volume percentage vol % | additives volume percentage vol % | porocity vol % |
|---|---|---|---|---|---|
| Example 1 | 19.4 | 69.8 | 7.5 | 0.3 | 3.0 |
| Example 2 | 58.4 | 35.1 | 3.6 | 0.3 | 2.6 |
| Example 3 | 38.5 | 43.3 | 13.7 | 0.8 | 3.7 |
| Example 4 | 38.1 | 43.6 | 14.0 | 0.5 | 3.2 |
| Example 5 | 39.0 | 43.7 | 10.0 | 5.0 | 2.3 |
| Comparative Example 1 | 25.2 | 14.7 | 15.1 | — | 45.0 |
| Comparative Example 2 | 38.8 | 58.1 | 0 | — | 3.1 |
| Comparative Example 3 | 39.1 | 29.3 | 29.2 | 0.1 | 2.3 |
| Comparative Example 4 | 37.3 | 43.7 | 14.1 | 0.1 | 4.8 |
| Comparative Example 5 | 53.8 | 44.1 | — | — | 2.2 |

Grinding Test 1 by Synthesized Grinding Stones

The above-mentioned grinding stones are equipped to a horizontal ultra-precision grinding machine and grinding tests of a silicon bare wafer (3 inches diameter) are made. The purpose of this Grinding Test 1 is to investigate each grinding stones only qualitatively, therefore detailed evaluations are not made in this test.

Grinding condition; rotating speed of grinding stone is 500 rpm, rotating speed of workpiece (wafer) is 50 rpm, grinding pressure is 0.1 kgf/$cm^2$ and a grinding liquid is not used. In evaluation items, "form stability of grinding stone" means degree of displacement by external change or by change of temperature and "transformation and wear of grinding stone" means transformation of shape and wear of grinding stone during actual grinding operations.

Qualitative evaluation results are summarized in Table 2 and the evaluation standards in Table 2 are mentioned as follows.

◎: very good O: good

Δ: not so good X: bad

TABLE 2

| | surface roughness | work damaged layer | machining efficiency | scratches | form stability of grinding stone | deformation and wear of grinding stone |
|---|---|---|---|---|---|---|
| Example 1 | ○ | ◎ | ○ | ◎ | ○ | ◎ |
| Example 2 | ○ | ◎ | ◎ | ◎ | ○ | ◎ |
| Example 3 | ◎ | ◎ | ◎ | ◎ | ◎ | ◎ |
| Example 4 | ◎ | ◎ | ○ | ○ | ◎ | ◎ |
| Example 5 | ◎ | ◎ | ◎ | ◎ | ◎ | ◎ |
| Comparative Example 1 | ◎ | ◎ | ◎ | ◎ | Δ | X |
| Comparative Example 2 | ◎ | ◎ | ◎ | ◎ | Δ | ○ |
| Comparative Example 3 | ○ | Δ | ◎ | Δ | ◎ | ◎ |
| Comparative Example 4 | ○ | Δ | ◎ | X | ◎ | ◎ |
| Comparative Example 5 | ○ | Δ | ○ | Δ | ◎ | Δ |

Grinding Test 2 by Synthesized Grinding Stones

The grinding stone of Example 5, by which the most excellent results are obtained, and grinding stone of Comparative Example 5, that uses cerium oxide whose $CeO_2$ purity is less than 60 weight %, are selected. Grinding tests are made on a bare silicon wafer of 300 mmϕ diameter whose surface is primarily ground by a diamond grinding stone of #800 grain size (prescribed by JIS R 6001). The surface roughness of the silicon wafer after primary grinding is 13.30 nm. Grinding conditions; rotating speed of grinding stone is 500 rpm, rotating speed of workpiece (wafer) is 50 rpm, grinding pressure is 0.1 kgf/cm$^2$ and a grinding liquid is not used. The evaluation results of the ground surface are summarized in Table 3.

For reference, the evaluation results of the following two specimens are mentioned in Table 3. That is, a specimen prepared by grinding a bare silicon wafer of after primary grinding by the same process as mentioned above with a diamond grinding stone of #5000 grain size by a grinding condition of a rotating speed of the grinding stone of 1500 rpm, rotating speed of a workpiece (wafer) of 50 rpm, infeed speed of 10 μm/min and using water grinding liquid, and a specimen of polished silicon wafer polished by conventional polishing method. In this test, etching is made by using a mixed acid of hydrofluoric acid:nitric acid:acetic acid=9:19:2 at room temperature for 30 minutes. Surface roughness is measured by a phase interferometer (New View 200) of ZYGO Co., Ltd. Other evaluations for appearance are visual observation by an inspector.

TABLE 3

| | | by grinding stone of example 5 | by grinding stone of comparative example 4 | by grinding stone of #5000 diamond | by chemical mechanical polishing |
|---|---|---|---|---|---|
| surface roughness | Ra | 0.95 | 1.30 | 3.18 | 0.76 |
| nm | Ry | 6.20 | 9.26 | 20.05 | 5.22 |
| appearance of machining surface | | homogeneous mirror finished surface | shallow scratches are irregularly formed | regular scratches are observed | homogeneous mirror finished surface |
| surface after etched | | etch pit is not observed | striped etch pits are observed | many striped etch pits are observed | etch pit is not observed |

As clearly understood from the results mentioned in Table 3, surface roughness and appearance of a wafer ground by the grinding stone of the present invention (Example 5) are almost same as to that of the wafer obtained by a conventional chemical mechanical polishing method, and regular scratches, which are observed in a wafer ground by a diamond grinding stone, are not observed. The ground surface is etched by a mixed acid and the etched surface is inspected. On the surface of the silicon wafer ground by the grinding stone of the present invention, no etch pits are observed and it is almost the same as that of the wafer obtained by the conventional chemical mechanical polishing method. However, on the surface of the silicon wafer ground by the diamond grinding stone, many striped etch pits were observed. Further, depth by etching is also the same as the wafer obtained by a conventional chemical mechanical polishing method. From the results shown in Tables 2 and 3, it is obviously understood that the graphite cluster diamond added as an additive contributes to an improvement in the lubricity of the grinding stone, releasing ability of abrasive grains (self dressing ability of abrasive grains), smoothing ability of the fine cutting edge of $CeO_2$ (has a single crystal structure of fine particles of approximately 50 nm or more to an average particle size of 1-3 μm), lightening of thermal stoppage to bonding material and damping of vibration of abrasive grains, bonding material and at the interface of the abrasive grains and bonding material, accordingly, the graphite cluster diamond is an essential factor in generating the grinding force of the abrasive grains.

Further, in a case of the grinding stone of Comparative Example 4, which uses cerium oxide whose purity is less than 60 weight %, a few shallow scratches are formed irregularly and it cannot be actually used.

Figure 2:
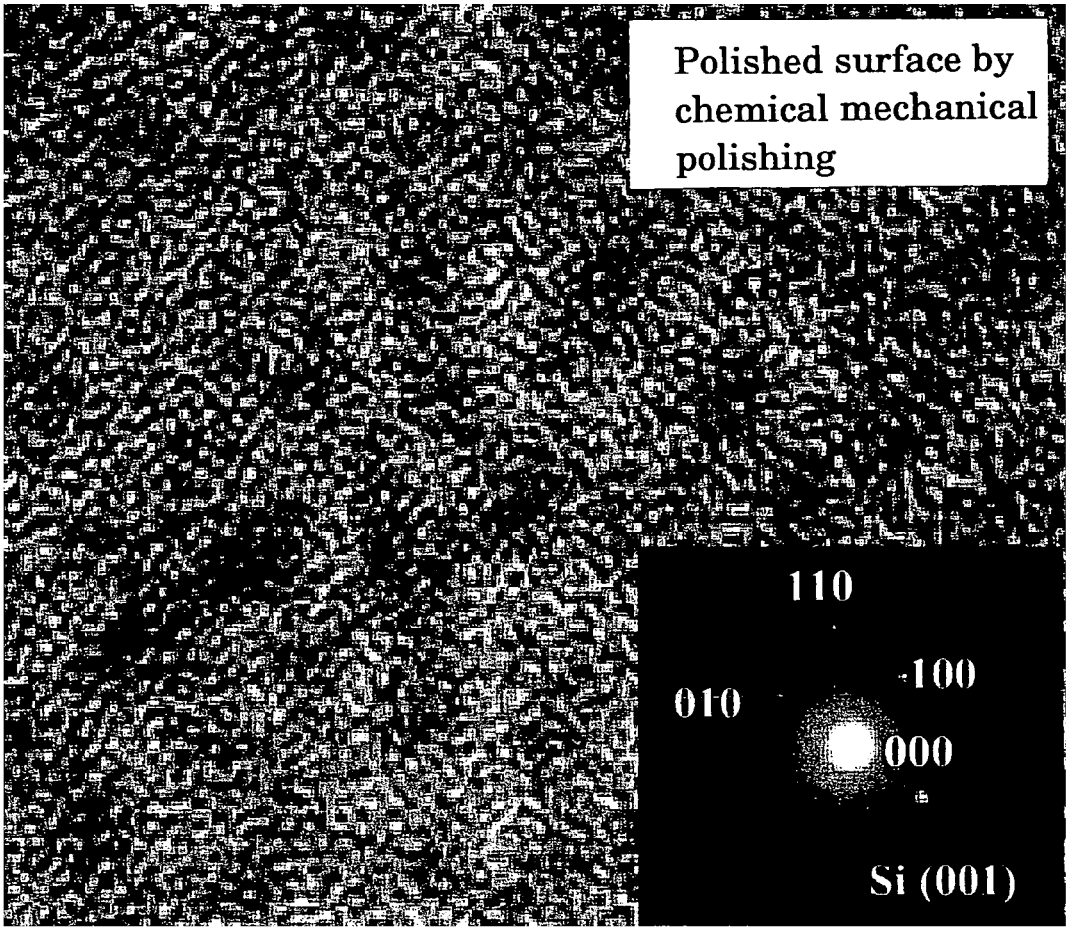
FIG. 2 is a TEM observation picture of the surface of a silicon wafer polished by chemical mechanical polishing and the electron beam diffraction of it (right lower part).

FIG. 1 is a TEM (Transmission Electron Microscope) observation picture of the surface of a silicon wafer ground by the grinding stone of Example 3 and electron beam diffraction of it and FIG. 2 is a TEM observation picture of the surface of a silicon wafer polished by a conventional polishing method (chemical mechanical polishing method) and electron beam diffraction of it. As clearly understood from these Figs, on the surface of the silicon wafer ground by dry state grinding using the grinding stone of the present invention, the lattice structure of a Si single crystal can be observed, on the other hand, on the finished surface of the silicon wafer polished by the conventional chemical mechanical polishing method, the lattice structure cannot be observed because an amorphous $SiO_2$ layer exists on the surface. That is, in the dry state grinding using a synthetic CM grinding stone, the lattice image of the Si(001) face is in-line coordinated and maintains a normal atomic lattice distance. However, in the final polished (chemical mechanical polishing method) surface, said lattice image cannot be observed. Further, in a case of a synthetic grinding stone of the present invention, the atomic lattice diffraction of Si(001) face shows diffraction images at prescribed diffraction sites and angles, however, in the case of a final polished surface by a conventional polishing method, a halo appears and n-pattern, which indicates the formation of amorphous $SiO_2$ is recognized. In a machining layer by the CM grinding stone, there is no defect such as cracking, plastic strain or dislocation. Therefore, machining with no machining layer can be obtained by the CM grinding stone.

A 3.5 nm×7 nm region is measured on a 300 mmϕ silicon wafer obtained by the synthesized grinding stone of the present invention, using TEM observation (observed by 400 Kv, 800000 magnification) and an atomic force prove microscope (product of Asylum Research Inc., MFP-30), and a result that a Si single crystal atomic lattice (011) face distance is 3.94 Å is obtained, and this result almost meets with a theoretical space wave length of 3.84 Å. This result shows 0.1 Å lattice strain and means that the so-called residual strain is almost zero. In a TEM observation image (ground surface by CM grinding stone) of FIG. 1, each lattice face is clearly observed, accordingly, it is understood that a Si single crystal structure is formed from the surface. Therefore, by use of the synthetic grinding stone of the present invention, machining of a 300 mm ϕ silicon wafer without a machining layer and having a silicon single crystal structure as it is can be accomplished.

In the synthetic grinding stone for silicon wafer grinding of the present invention, reaction of $(CeO_2)$— and $(SiO_2)^{2+}$ proceeds during the grinding process in a constitution composed of, abrasive grains+bonding material+filler+additive and a composite product indicated by $Ce_2O_3.SiO_2$ is formed on the surface. This composite product is an amorphous compound whose bonding strength is very weak. This composite product can be easily removed by a grinding stone designed so $CeO_2$ abrasive grains have optimum grinding removing ability, that is, performing optimum machining condition (use of machining temperature of 150-250° C.) by combination of, $CeO_2$+GCD+bonding material+filler+additive, optimum conditions of blending ratio and grinding condition. Accordingly, a silicon wafer without a machining layer can be obtained by the use of highly purified cerium oxide fine particles, not using the cutting function of abrasive grains by applying an evolved machining theory, which can overcome an ultra-precision grinding machine by a constant-pressure processing method, that is, can overcome mechanical accuracy.

INDUSTRIAL APPLICABILITY

As mentioned above, according to the grinding stone of the present invention, polishing of a silicon wafer (chemical mechanical polishing) using a conventional polishing pad and polishing compound (slurry) can be replaced by a synthetic CM grinding stone possessing fixed abrasive grains. That is, by the use of CM grinding stone machining using a synthetic grinding stone, not only problems of form accuracy such as roll off, which as polished silicon wafer polished by conventional chemical mechanical polishing method has, can be solved, but also problems caused by the use of a polishing pad and polishing compound containing secondary deficiencies can be solved. In other words, the solving of problems regarding the instability of machining accuracy in continuous use, pollution of machines and circumstance caused by the use of loose abrasive grains, pollution of a workpiece itself and environmental pollution by wasted liquid becomes possible. Further, by the grinding stone of the present invention, it becomes possible to perform a throughout continuous process from a cut wafer to final polishing by not using a machining liquid. Accordingly, the machining cost by a conventional method that uses a large amount of expensive loose abrasive grains or slurry can be reduced. That is, the grinding stone of the present invention is very effective for silicon wafer machining and can contribute greatly to a semiconductor field.

The invention claimed is:

1. In a synthetic grinding stone used in a grinding process without a grinding fluid, the improvement comprising said grinding stone comprising particles of cerium oxide as abrasive grains, a resin as a bonding material, a metal salt as a filler and particles of graphite cluster diamond as an additive, wherein the purity of the cerium oxide is at least 60 weight %, the content of the salt as a filler is in the range of 1 to less than 20 volume % and the content of the particles of graphite cluster diamond as an additive is in the range of from 0.1 to less than 20 volume %.

2. The synthetic grinding stone of claim 1, wherein a resin as a bonding material is at least one thermosetting resin selected from the group consisting of phenol resins, epoxy resins, melamine resins, rigid urethane resins, urea resins, unsaturated polyester resins, alkyd resins, polyimide resins and polyvinylacetal resins.

3. The synthetic grinding stone of claim 1, wherein the salt as a filler is a metal salt consisting of an inorganic acid and an inorganic base.

4. The synthetic grinding stone according to claim 1, wherein the particle size of the graphite cluster diamond is from 5 angstrom (Å) to 300 Å.

5. The synthetic grinding stone of claim 1, wherein the purity of the cerium oxide is at least 95 weight %.

6. The synthetic grinding stone of claim 1, wherein the resin as a bonding material is a phenol resin, the salt as a filler is sodium carbonate and the purity of the cerium oxide is at least 65.8 weight %.

7. The synthetic grinding stone of claim 6, wherein the purity of the cerium oxide is at least 96.5 weight %.

* * * * *